US005853313A

United States Patent [19]

Zheng

[11] Patent Number: 5,853,313

[45] Date of Patent: Dec. 29, 1998

[54] CONSTRUCTIONAL TOY WITH DEFORMABLE JOINTS

[75] Inventor: Yu Zheng, Covina, Calif.

[73] Assignee: Patent Category Corp., Monrovia, Calif.

[21] Appl. No.: 632,678

[22] Filed: Apr. 16, 1996

[51] Int. Cl.[6] ..... A63H 33/08

[52] U.S. Cl. ..... 446/106; 446/107; 446/115; 446/116; 446/121; 403/345

[58] Field of Search ..... 446/85, 106–109, 446/113–116, 120, 121, 127; 403/345

[56] References Cited

U.S. PATENT DOCUMENTS

| | | | |
|---|---|---|---|
| D. 236,221 | 8/1975 | McAllister et al. . | |
| D. 252,951 | 9/1979 | Schuring . | |
| 1,562,006 | 2/1925 | Sichterman . | |
| 1,882,607 | 10/1932 | Howard . | |
| 2,104,742 | 1/1938 | Fleischer | 446/106 |
| 2,278,327 | 3/1942 | Magnus et al. | 446/124 |
| 2,712,200 | 9/1955 | Dearling | 446/106 |
| 2,844,910 | 7/1958 | Korchak | 446/85 |
| 3,199,246 | 8/1965 | Fischer | 446/108 |
| 3,432,960 | 3/1969 | Bombaci . | |
| 3,701,214 | 10/1972 | Sakamoto . | |
| 3,855,752 | 12/1974 | Aylon | 52/605 |
| 3,882,630 | 5/1975 | Bianco | 446/85 |
| 4,107,894 | 8/1978 | Mullins | 52/593 |
| 4,182,072 | 1/1980 | Much . | |
| 4,519,724 | 5/1985 | Ribas | 446/115 |
| 4,740,188 | 4/1988 | Coster | 446/106 |
| 4,776,719 | 10/1988 | Kreider | 446/122 |
| 5,212,842 | 5/1993 | Glydon | 446/85 |
| 5,215,490 | 6/1993 | Szoradi | 446/115 |
| 5,251,900 | 10/1993 | Gallant | 273/157 R |
| 5,281,181 | 1/1994 | McCollum | 446/106 |
| 5,378,185 | 1/1995 | Ban | 446/120 |

FOREIGN PATENT DOCUMENTS

| | | | |
|---|---|---|---|
| 132550 | 5/1949 | Australia | 446/114 |
| 931491 | 2/1948 | France | 446/113 |
| 956627 | 2/1950 | France | 446/113 |
| 207086 | 2/1909 | Germany | 446/114 |
| 2301981 | 7/1974 | Germany | 446/106 |
| 325343 | 6/1936 | Italy | 446/113 |

*Primary Examiner*—Robert A. Hafer
*Assistant Examiner*—Jeffrey D. Carlson
*Attorney, Agent, or Firm*—Raymond Sun

[57] ABSTRACT

A constructional toy system provides a plurality of pieces that can be used to construct an object. Each piece has at least one section having opposing first and second notches, and a tongue defining a neck between the first and second notches, the tongue having a width and opposing first and second flaps. Each piece further includes at least one aperture having an edge and having a dimension which is substantially smaller than the width of the tongue so that the opposing flaps of the tongue of one of the sections of the instant piece or another piece must be bent to insert the tongue through the aperture to effectuate a connection of the section with the instant piece at the location of the aperture.

14 Claims, 19 Drawing Sheets

CONSTRUCTIONAL TOY WITH DEFORMABLE JOINTS

BACKGROUND OF THE INVENTION

1. Field of the Invention

The present invention relates to a constructional toy system, and in particular, to two or three dimensional model objects that can be constructed or assembled from a plurality of pieces. The pieces each include at least one aperture and at least one deformable section that can be deformable to insert the section through an aperture in another piece, the section returning to its original shape after insertion through the aperture, to form a joint between the two pieces.

2. Description of the Prior Art

Constructional toys are popular among both children and adults. Such constructional toys can include three-dimensional self-standing structures and objects that are assembled by interconnecting a variety of pieces.

Examples of prior three-dimensional structures that are assembled from pieces are illustrated in U.S. Pat. Nos. 2,278,327 (Magnus et al.), 3,701,214 (Sakamoto) and 5,251,900 (Gallant). The pieces used to assemble these structures are interconnected by means of dovetail joints. However, the use of dovetail joints mean that these structures tend to be bulky and not flexible, and therefore do not allow the user to assemble a wide variety of three-dimensional structures and sometimes make them difficult to move around, especially by children.

Another example of a prior constructional toy assembled from pieces is illustrated in U.S. Pat. No. 2,712,200 (Dearling), in which each piece or element 10 has a tongue 18 formed by creating notches 12 at a neck 14, and a cross-shaped aperture 20 having a longitudinal slot 22 and a shorter transverse slot 24. To join the two elements 10 and 10*a*, the tongue 18*a* of element 10*a* is first inserted through the longitudinal slot 22 until the neck 14*a* reaches the opening of transverse slot 24, after which the neck 14*a* is twisted until it is seated in transverse slot 24. Unfortunately, the cross-shaped aperture limits the angles at which the piece 10*a* can be connected, thereby limiting the variety of structures or objects that can be assembled from the pieces.

Another problem associated with certain prior constructional toys is that the connections are not sufficiently stable to permit an assembled structure to be retained in a permanent state and to be moved from and to different locations. An example is illustrated in U.S. Pat. No. 5,378,185 (Ban).

Thus, there remains a need for a plurality of interconnecting pieces that can provide stable connections for the assembled object, which have enough flexibility and variety so that they can be assembled into a wide variety of different three-dimensional objects, and which objects are lightweight and can be moved around easily.

SUMMARY OF THE DISCLOSURE

In order to accomplish the objects of the present invention, there is provided a constructional toy system having a plurality of pieces that can be used to construct an object. Each piece according to the present invention has at least one section having opposing first and second notches, and a tongue defining a neck between the first and second notches, the tongue having a width and opposing first and second flaps. Each piece further includes at least one aperture having an edge and having a dimension which is substantially smaller than the width of the tongue so that the opposing flaps of the tongue of one of the sections of the instant piece or another piece must be bent to insert the tongue through the aperture to effectuate a connection of the section with the instant piece at the location of the aperture. The neck of each section has opposing first and second neck edges at the first and second notches, respectively, so that when the neck is fitted in the aperture to effectuate the connection, the first and second neck edges are adjacent the edge of the aperture.

In a preferred embodiment according to the present invention, the width of each aperture of the pieces has a dimension of about half of the width of the tongue of the pieces. In one preferred embodiment, the aperture has four straight edges and four convex edges, each of the straight edges being alternated by a convex edge so that each straight edge is opposed by another straight edge within the aperture and each convex edge is opposed by another convex edge within the aperture. In another preferred embodiment, the aperture has a circular configuration with a circumferential edge. In yet another preferred embodiment, the aperture has a cross-shaped configuration comprising a longitudinal slot and a transverse slot, each slot having a length which is about half the width of the tongue so that the opposing flaps of the tongue of one of the sections of the instant piece or another piece must be bent to insert the tongue through either slot. In a further preferred embodiment, the aperture has four straight edges connected to each other to define either a diamond-shaped or square configuration. In yet a further preferred embodiment, the aperture has three straight edges connected to each other to define a triangular configuration. In yet another preferred embodiment, the aperture has five or more straight edges connected to each other to define a polygonal configuration.

In a preferred embodiment according to the present invention, at least one aperture of at least one of the pieces has at least one slit extending from the aperture for a short distance along the body, the slit defining first and second deformable body portions adjacent the slit which are deformable to further facilitate insertion of the tongue through the aperture. In yet another preferred embodiment, each piece further includes a slit extending from the aperture to a longitudinal side edge, the slit defining first and second deformable body portions adjacent the slit that may be bent to create an opening to allow the neck of another piece or the instant piece to be inserted therethrough for connection in the aperture.

The constructional toy system according to the present invention further includes a set of connectors for connecting two pieces. A preferred embodiment of a connector includes at least one aperture for receiving one or more necks of one or more pieces. Another preferred embodiment of a connector includes one or more pairs of opposing notches for retaining the neck of one or more pieces.

The constructional toy system according to the present invention further includes at least one wheel system. The wheel system includes a plurality of wheels, each having one or more apertures adapted to receive therethrough a shaft. The shaft is provided with a plurality of openings that are adapted to receive protrusions extending radially inwardly from the central opening of a hub. The hub defines the limit of slidable advancement by the along the shaft.

The constructional toy system according to the present invention further includes a plurality of cut-outs that have the same configuration and size as the apertures of the pieces. The cut-outs may be inserted into unused apertures of the pieces for decorative purposes.

Thus, the constructional toy system according to the present invention allows the user to assemble a large variety of simple and complex two and three-dimensional objects. The constructional toy system of the present invention is therefore challenging and exciting, and is a good educational toy for children. The connections of the pieces, wheels and connectors are stable, and the material used is light-weight, so that the assembled objects can be kept in a permanent state and moved around easily.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
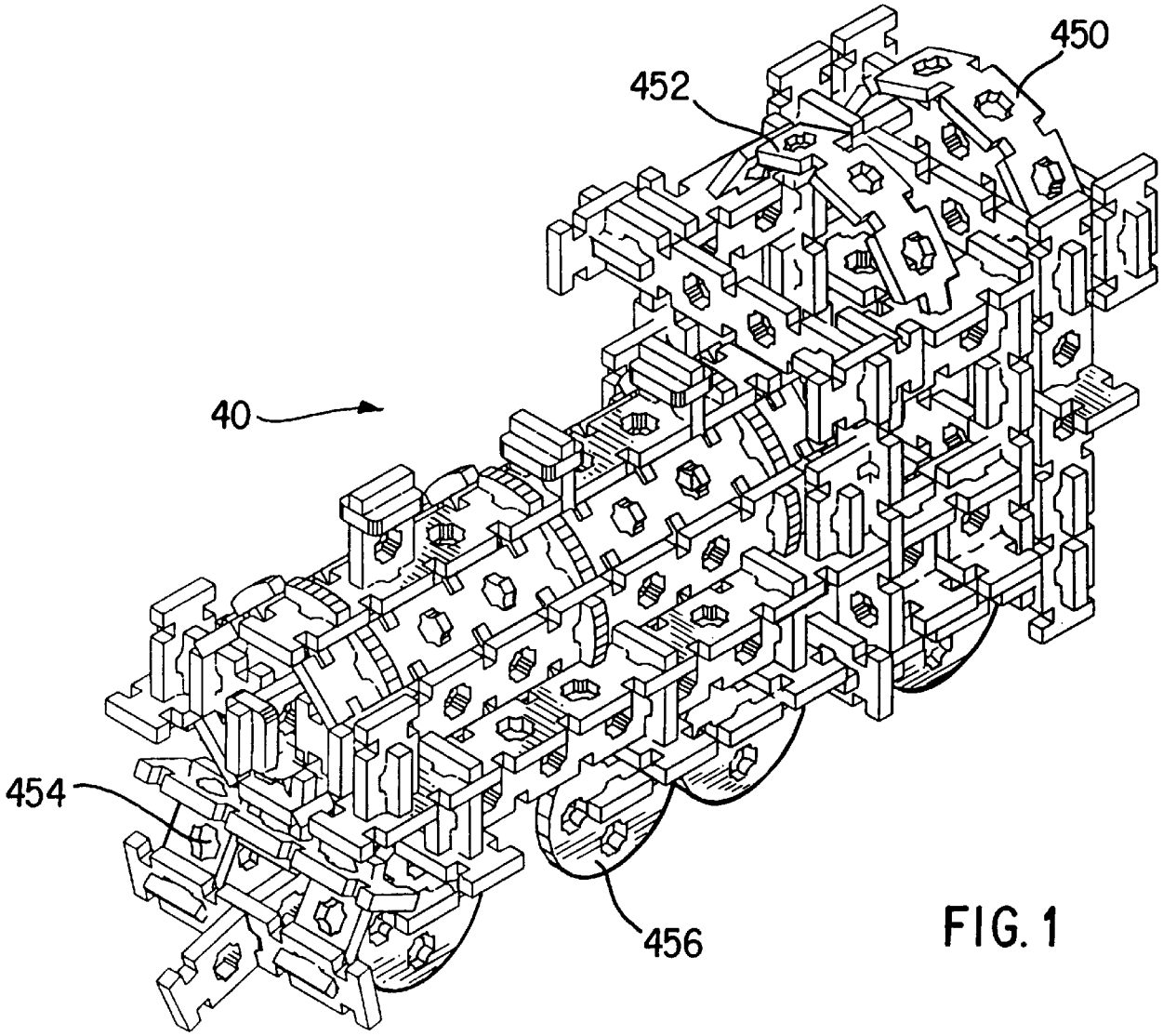
FIG. 1 is a perspective view of a three-dimensional structure, resembling a train, assembled with the pieces according to the present invention.

An example of a three-dimensional object 40 made from the constructional toy system of the present invention is shown in FIG. 1. Object 40 takes the form of the front engine of a train, and is constructed or assembled by connecting a plurality of pieces as described hereinbelow. Each piece has a deformable section which is connected to an aperture of the same or another piece to create a joint or connection. The dimensions of each aperture are sized and configured to be smaller than the width of the deformable section so that the deformable section must be deformed or bent to insert it through the aperture to create the joint. Each piece has at least one deformable section and at least one aperture, and can have any number of deformable sections and apertures. In addition, the constructional toy system according to the present invention may include wheel systems and connectors that may be used to interconnect two or more pieces. The pieces can be provided in different shapes and sizes to allow for variety in construction. For example, objects created from the pieces according to the present invention include but are not limited to planes, ships, trains, buildings, furniture, automobiles, animals, plants, belts, watches, visors, and abstract sculptures.

Examples of pieces according to the present invention are illustrated in FIGS. 2–17 and 26–34. Each of the pieces according to the present invention is made from a material that is soft and flexible to allow it to be bent, folded or otherwise deformed, yet strong enough to allow the structures or objects created from connections of such pieces to have structural stability. Examples of such materials include but are not limited to foam, polyethylene, polyurethane and PVC (expanded foam).

Figure 2C:
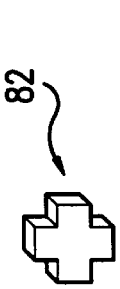
FIG. 2C is a perspective view of a cut-out from the aperture of the piece of FIG. 2A.
Figure 2B:
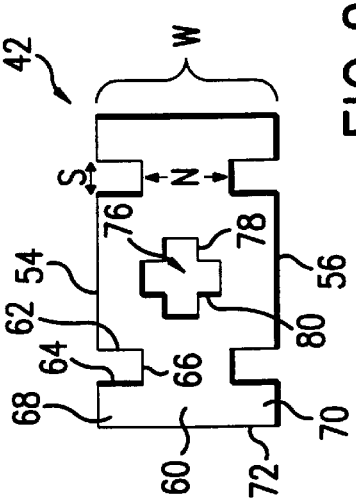
FIGS. 2A and 2B are perspective and front views, respectively, of a first embodiment of a piece according to the present invention.
Figure 2A:
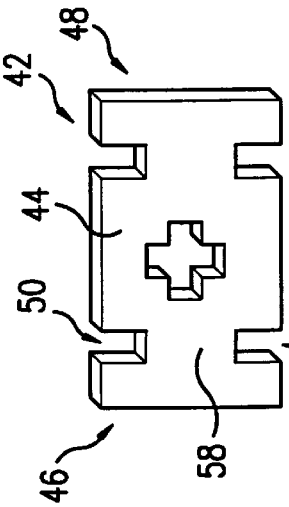

Referring to FIGS. 2A–2C, a first preferred embodiment of a piece 42 has a substantially rectangular body 44 with two deformable sections 46 and 48 at opposite ends of the body 44. The thickness of the body 44 is preferably consistent throughout. Deformable section 46 has opposing notches 50 and 52 that are cut from the longitudinal side walls 54 and 56, respectively, of the body 44 to define a neck 58 and a tongue 60. The notches 50, 52 are themselves defined by substantially straight side edges 62, 64 and a substantially straight neck edge 66. The tongue 60 has two flaps 68 and 70 at opposite sides of the neck 58 and a substantially straight edge 72 at the end thereof. The deformable section 48 is identical to deformable section 46. An aperture 76 is cut out or otherwise provided in the body 44 at about a central portion thereof. The aperture 76 is substantially cross-shaped and is defined by a longitudinal slot 78 and a transverse slot 80. A cut-out 82 shown in FIG. 2C has the same configuration and size as the aperture 76 and may be used in the manner described hereinbelow.

Some non-limiting preferred dimensions for the piece 42 shall be provided to illustrate the relationship between the sizes of the tongue 60, the neck 58 and the aperture 76. The dimensions will be described relative to a basic unit "x", with x being the thickness of the body 44. For example, the width W of the deformable sections 46 and 48 is about 4x, the dimension N of the neck 58 is about 2.25x, the width S of the notches 50 and 52 is about x, and the length of both the longitudinal and transverse slots 78 and 80 is about 2x. Alternatively, the length of the longitudinal and tranverse slots 78 and 80 can be different, but the length of either slot 78 or 80 should not be much longer than 2x. In a preferred embodiment, the basic unit x is equal to 0.25 inches. It will be appreciated that the above dimensions can be changed by changing the dimension of the basic unit, and any change in one of these dimensions would necessitate a corresponding change in the other dimensions.

Figure 3C:
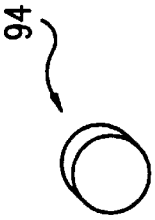
FIG. 3C is a perspective view of a cut-out from the aperture of the piece of FIG. 3A.
Figure 3B:
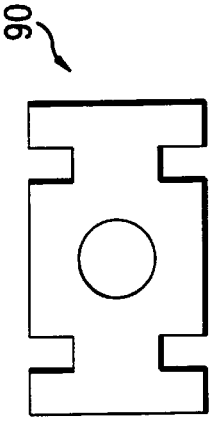
FIGS. 3A and 3B are perspective and front views, respectively, of a second embodiment of a piece according to the present invention.
Figure 3A:
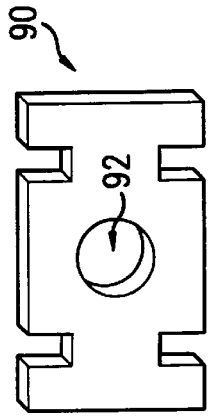

The second preferred embodiment 90 is illustrated in FIGS. 3A–3C. The piece 90 is essentially the same as the piece 42 except that the aperture 92, and its cut-out 94, are substantially circular. The relative dimensions of the aperture, neck and tongue (hereinafter referred to as "relative dimensions") are also substantially the same as those for piece 42, except that the diameter of the aperture 92 is about 2x.

Figure 4C:
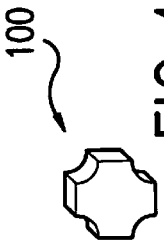
FIG. 4C is a perspective view of a cut-out from the aperture of the piece of FIG. 4A.
Figure 4B:
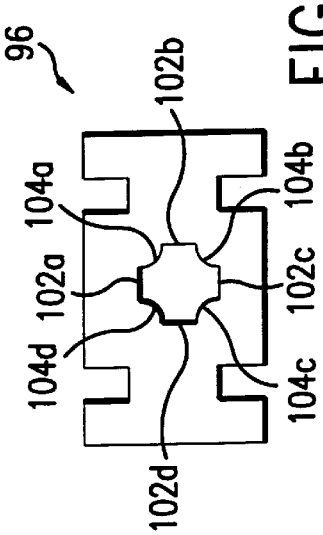
FIGS. 4A and 4B are perspective and front views, respectively, of a third embodiment of a piece according to the present invention.
Figure 4A:
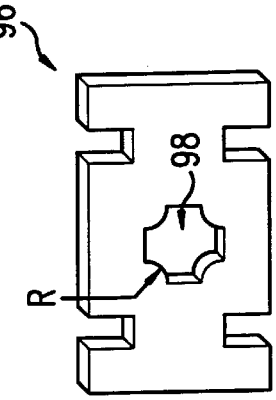

The third preferred embodiment 96 is illustrated in FIGS. 4A–4C. The piece 96 is essentially the same as the piece 42 except that the aperture 98, and its cut-out 100, are defined by four straight edges 102*a*, 102*b*, 102*c* and 102*d* and four convex edges 104*a*, 104*b*, 104*c* and 104*d*, each of the straight edges 102*a*, 102*b*, 102*c* and 102*d* being alternated by a convex edge 104*a*, 104*b*, 104*c* and 104*d* so that each straight edge is opposed by another straight edge within the aperture 98 and each convex edge is opposed by another convex edge within the aperture 98. The relative dimensions are also substantially the same as those for piece 42, except that the distance between opposing straight edges 102*a* and 102*c*, and between opposing straight edges 102*b* and 102*d*, is about 2x, and the distance between opposing convex edges 104*a* and 104*c*, and between opposing convex edges 104*b* and 104*d*, is about 1.875x. The radius R of each convex edge 104*a*, 104*b*, 104*c* and 104*d* are about 0.5x.

Figure 5:
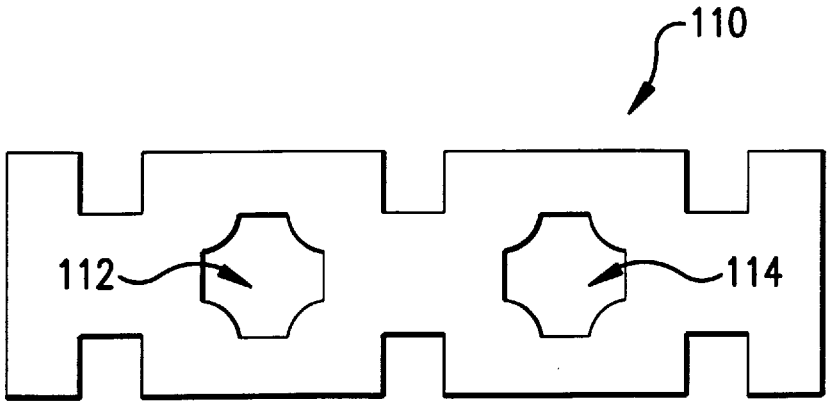
FIGS. 5–14 are front views of fourth through thirteenth embodiments of pieces according to the present invention.

The fourth preferred embodiment 110 is illustrated in FIG. 5. The piece 110 is essentially the same as the piece 42 except that it is longer and has two apertures 112 and 114. The apertures 112 and 114 have the same configuration as aperture 98 of piece 96. The relative dimensions are also substantially the same as those for piece 96, except that the length of piece 110 is longer.

Figure 6:
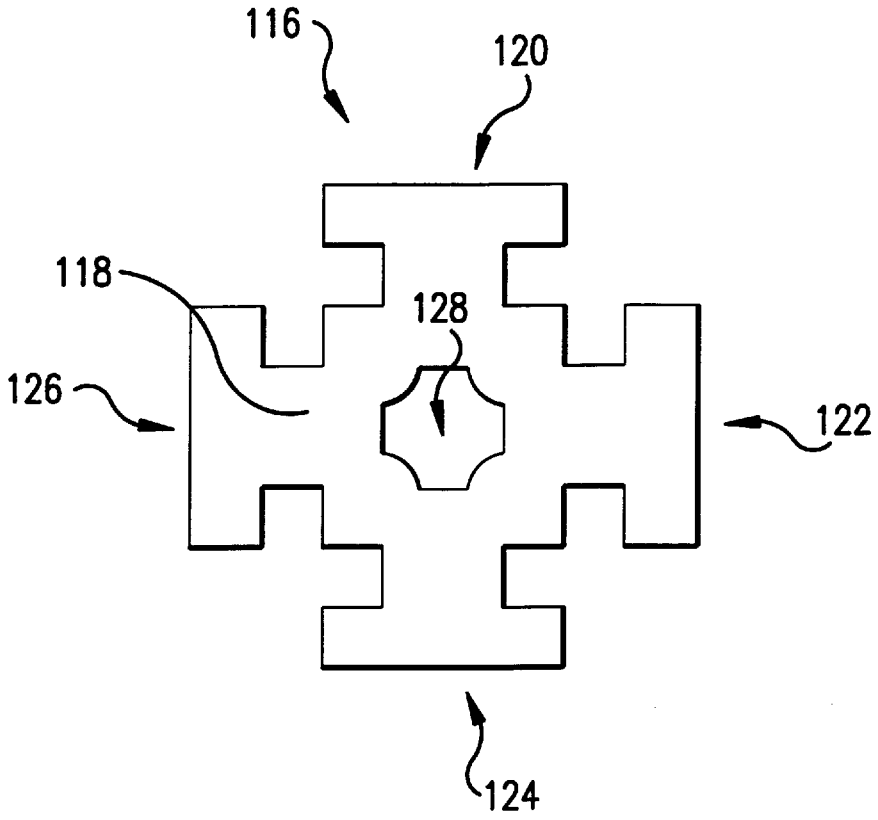

The fifth preferred embodiment 116 is illustrated in FIG. 6. The piece 116 has a substantially cross-shaped body 118 with four deformable sections 120, 122, 124 and 126, each provided at one of the four ends of the body 118. Each deformable section 120, 122, 124 and 126 is essentially the same as deformable section 46 described above. The piece 116 is also provided with one aperture 128 that has the same configuration as aperture 98 of piece 96. The relative dimensions are also substantially the same as those for piece 96.

Figure 7:
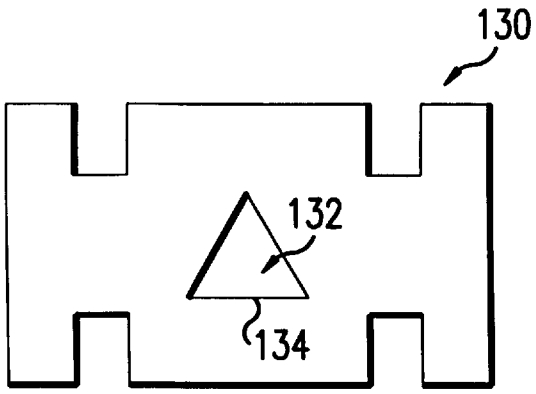

The sixth preferred embodiment 130 is illustrated in FIG. 7. The piece 130 is essentially the same as the piece 42 except that the aperture 132 is substantially triangular. The relative dimensions are also substantially the same as those for piece 42, except that the length of the aperture 132 from the apex to the midpoint of the edge 134 is about 2x.

Figure 8:
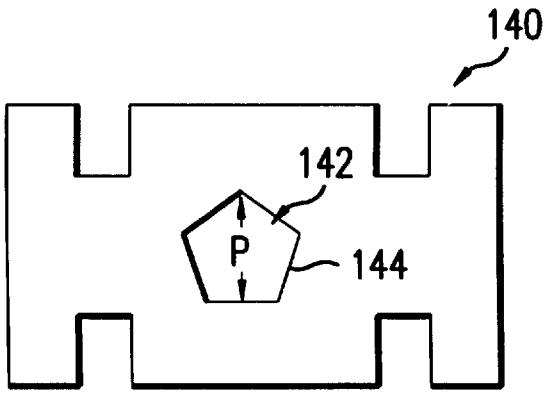

The seventh preferred embodiment 140 is illustrated in FIG. 8. The piece 140 is essentially the same as the piece 42 except that the aperture 142 is substantially polygonal having five sides. The relative dimensions are also substantially the same as those for piece 42, except that the length p (see FIG. 8) of the aperture 142 is about 2x.

Figure 9:
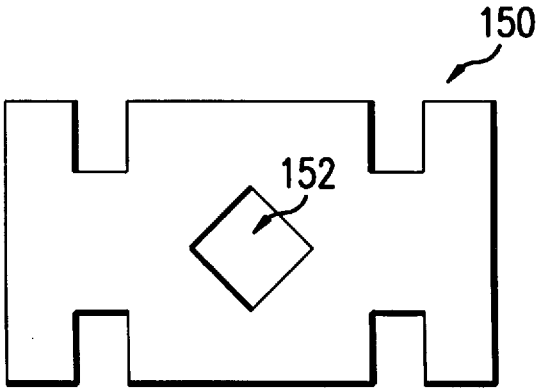

The eighth preferred embodiment 150 is illustrated in FIG. 9. The piece 150 is essentially the same as the piece 42 except that the aperture 152 is substantially diamond-shaped having four sides. The relative dimensions are also substantially the same as those for piece 42, except that the diagonal distance between each of the corners of the aperture 152 is about 2x. In addition, it will be appreciated that the aperture 152 can also assume a substantially square configuration with four sides.

Figure 10:
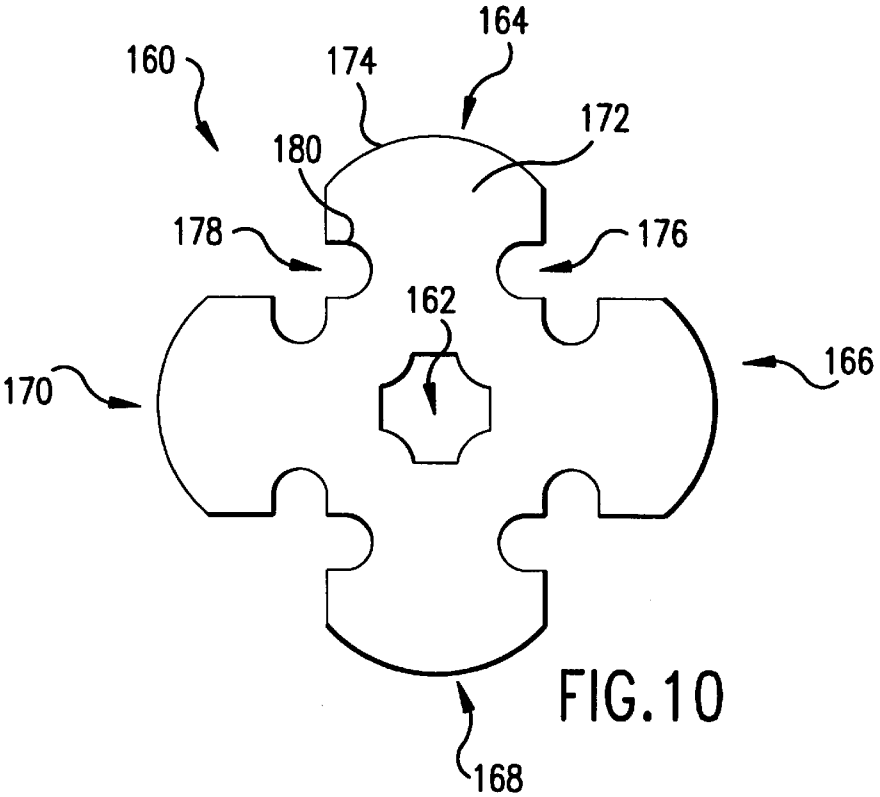

The ninth preferred embodiment 160 is illustrated in FIG. 10. The piece 160 is similar to the piece 116 in that both are substantially cross-shaped and the apertures 128 and 162 both have the same configuration. However, the four deformable sections 164, 166, 168 and 170 have a different configuration. The tongue 172 has a curved end edge 174, and the notches 176 and 178 are defined by a substantially U-shaped edge 180. Otherwise, the relative dimensions may also be substantially the same as those for piece 116.

Figure 11:
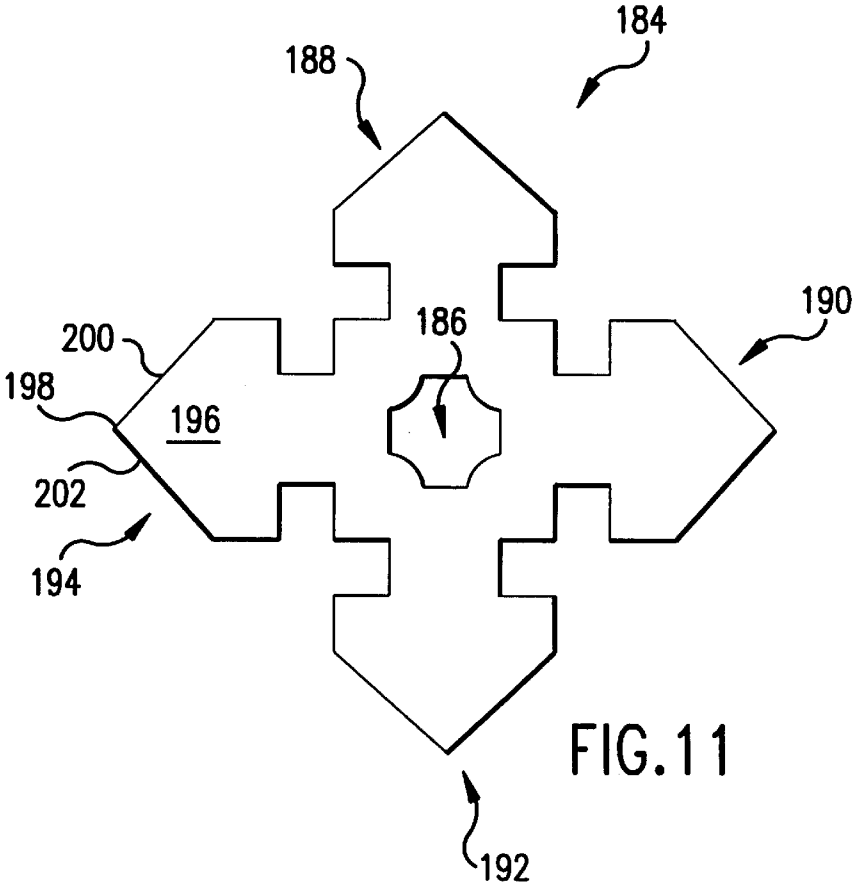

The tenth preferred embodiment 184 is illustrated in FIG. 11. The piece 184 is similar to the piece 116 in that both are substantially cross-shaped and the apertures 128 and 186 have the same configuration. However, the four deformable sections 188, 190, 192 and 194 have a different configuration. The tongue 196 is shaped similar to an arrow or triangle, having a tip 198 connecting two end edges 200 and 202. Otherwise, the relative dimensions may also be substantially the same as those for piece 116.

Figure 12:
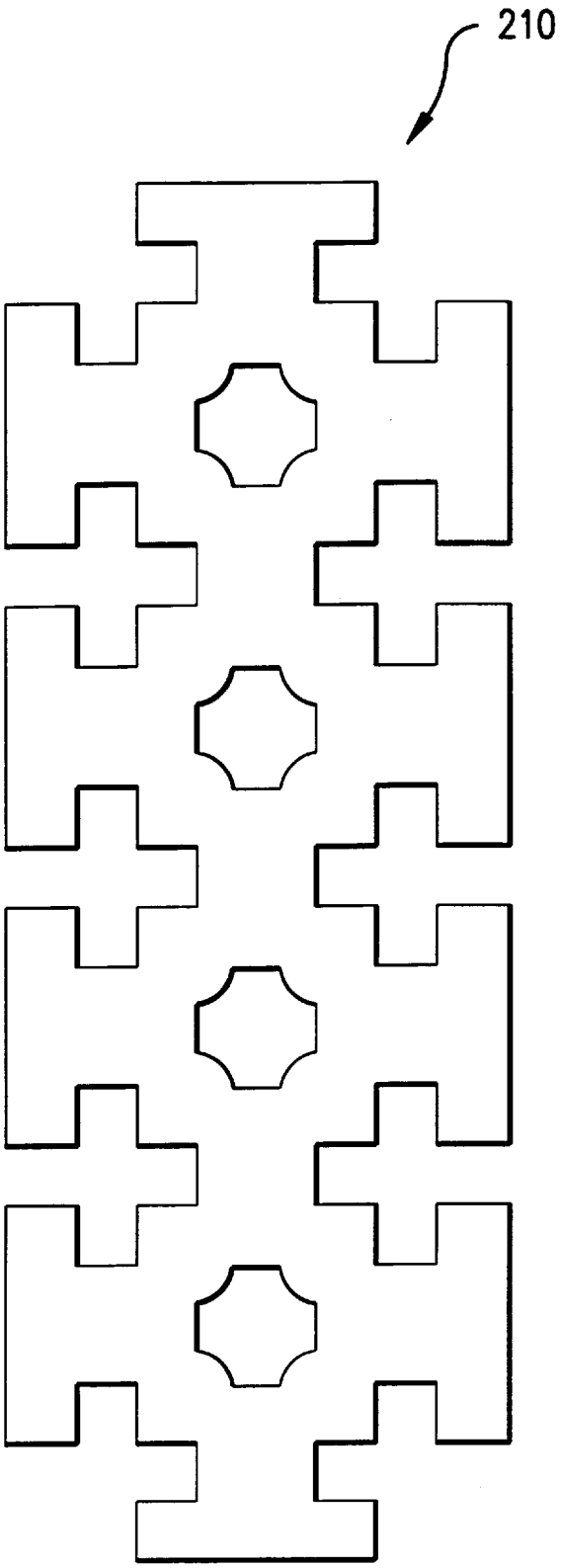

The eleventh preferred embodiment 210 is illustrated in FIG. 12. The piece 210 is essentially an extension or lengthening of the piece 116, so that piece 210 has four apertures, and a total of ten deformable sections. The piece 210 can also be viewed as a connection of a plurality of the pieces 116. The relative dimensions of the apertures, the deformable sections and the necks are also substantially the same as those for piece 116.

Figure 13:
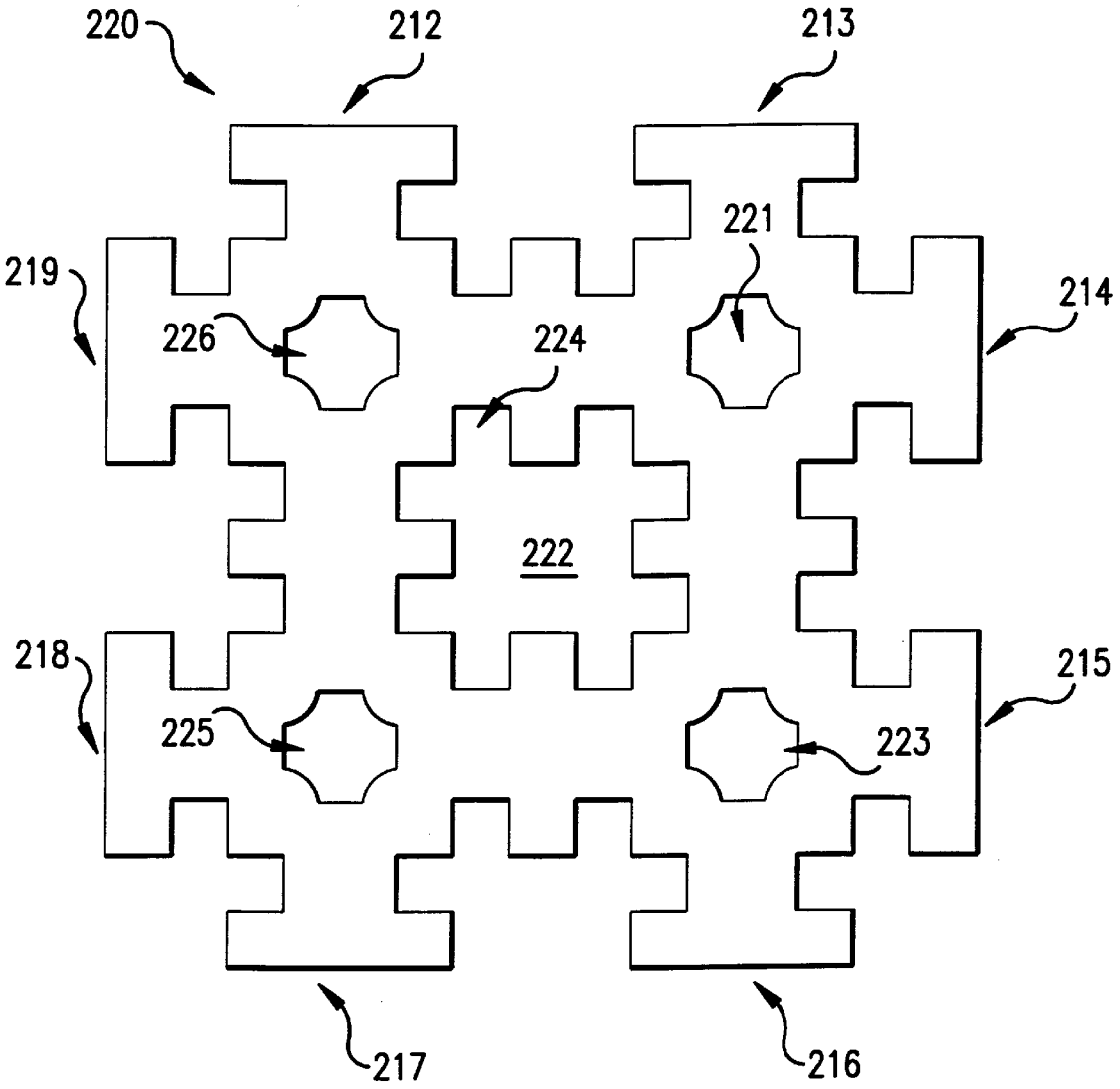

The twelfth preferred embodiment 220 is illustrated in FIG. 13. The piece 220 has eight deformable sections 212, 213, 214, 215, 216, 217, 218 and 219 and four apertures 221, 223, 225 and 226. In addition, a larger central aperture 222 is provided having notches 224 that can be connected to the connectors described hereinbelow, or just used for decorative purposes. The relative dimensions are also substantially the same as those for piece 116.

Figure 14:
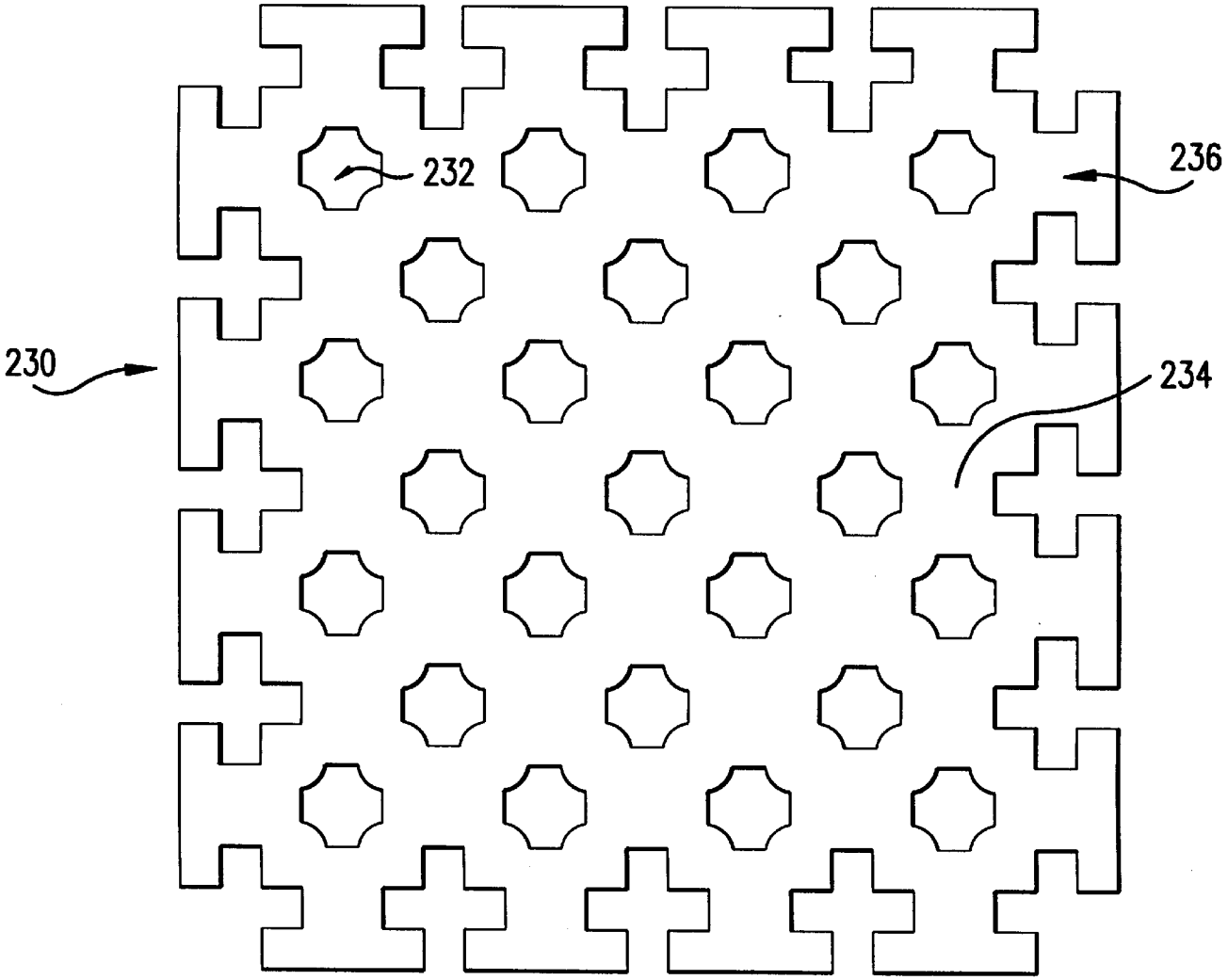

The thirteenth preferred embodiment 230 is illustrated in FIG. 14. The piece 230 has a plurality of apertures 232 spaced-apart in the body 234 and sixteen deformable sections 236 spaced-apart along the outer edges of the piece 230 with four deformable sections on each side. The relative dimensions of the apertures 232 and the deformable sections 236 are also substantially the same as those for piece 116.

Figure 15:
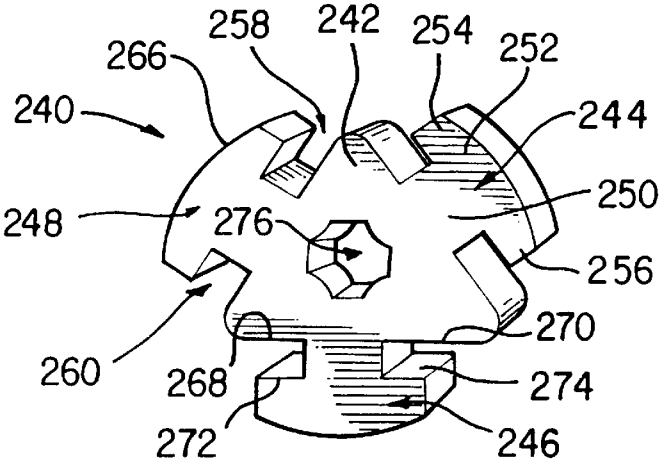
FIGS. 15–17 are perspective views of fourteenth through sixteenth embodiments of pieces according to the present invention.

The fourteenth preferred embodiment 240 is illustrated in FIG. 15. The central body 242 of the piece 240 is substantially triangular, and has three deformable sections 244, 246 and 248, each provided at one of the three sides of the body 242. The three deformable sections 244, 246 and 248 are similar to the deformable section 46 of piece 42 in that they each include a neck 250, a tongue 252 with two flaps 254, 256, and two notches 258, 260 that are the same as the corresponding elements of deformable section 46. However, the end edge 266 of each deformable section 244, 246 and 248 is curved, and side walls 268 and 270 in the notches 258, 260, respectively, are longer than side walls 272, 274. An aperture 276 is provided in the central body 242 and has the same configuration as aperture 98 of piece 96. The relative dimensions of the apertures, the deformable sections and the necks are also substantially the same as those for pieces 42 and 96.

Figure 16:
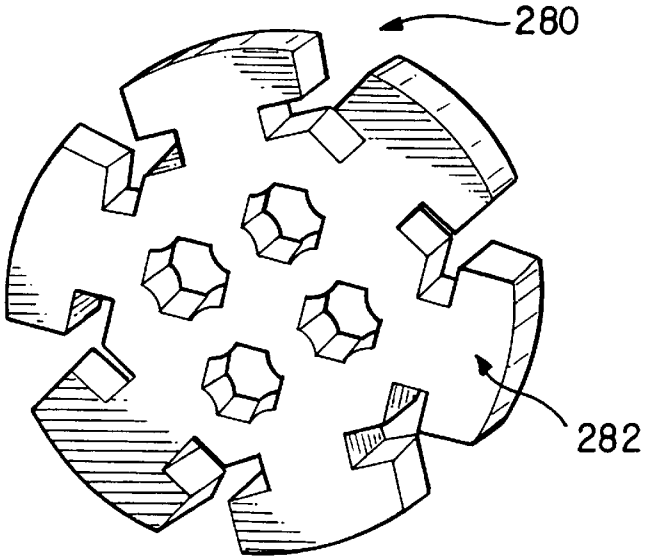

The fifteenth preferred embodiment 280 is illustrated in FIG. 16. The piece 280 is similar to the piece 240 except that it has been enlarged to assume a substantially circular configuration providing six deformable sections and four apertures. The relative dimensions of the apertures, the deformable sections and the necks are also substantially the same as those for piece 240.

Figure 17:
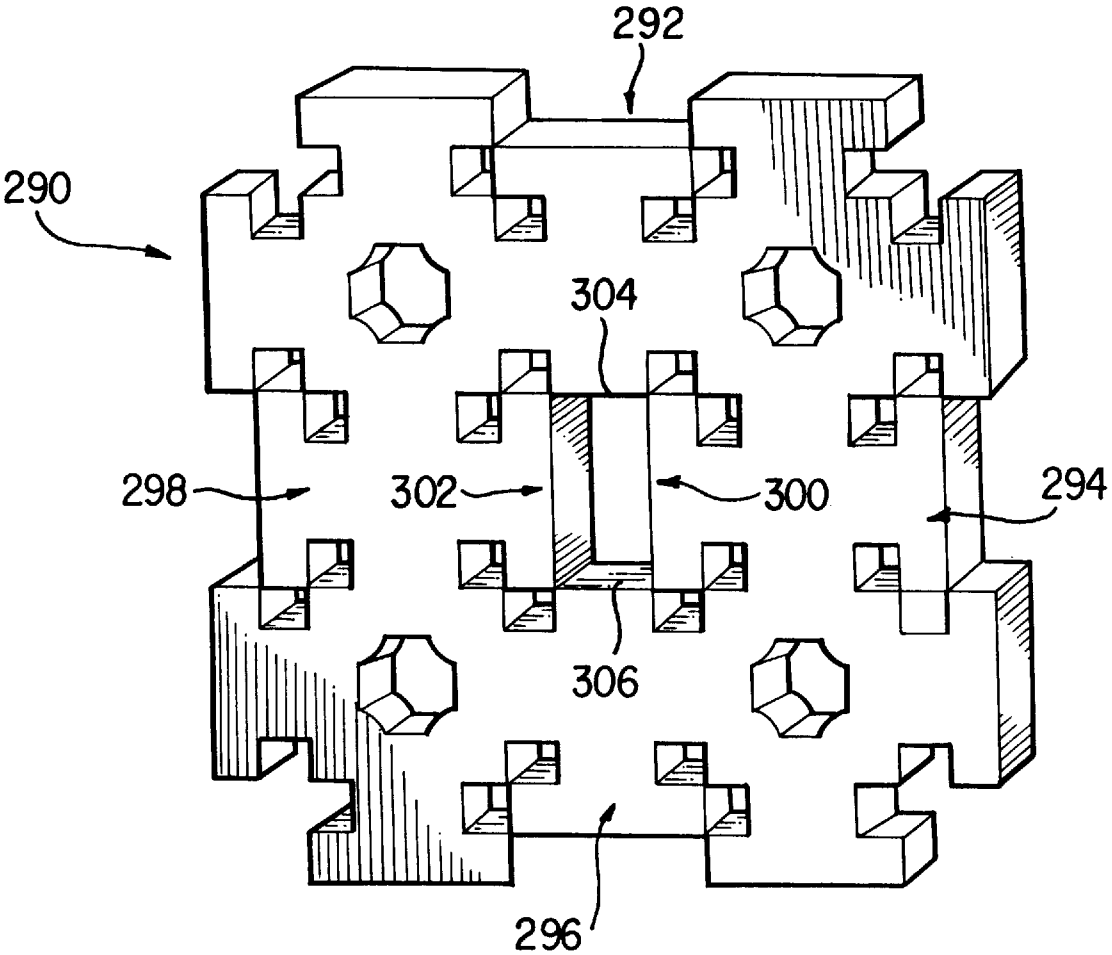
Figure 18A:
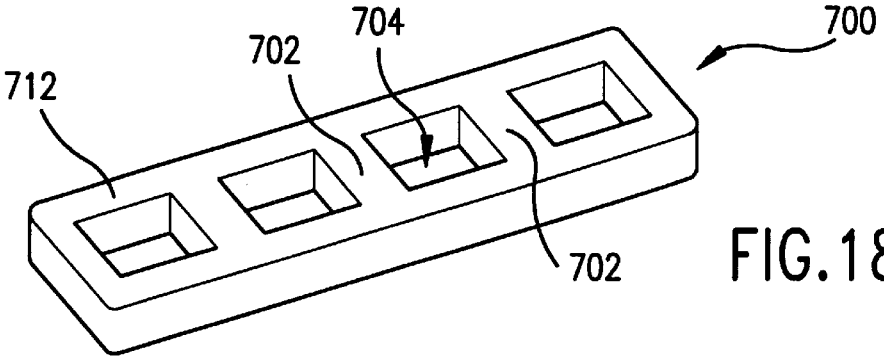
FIGS. 18A–18F are perspective views of connectors for use in connecting pieces according to the present invention.
Figure 18B:
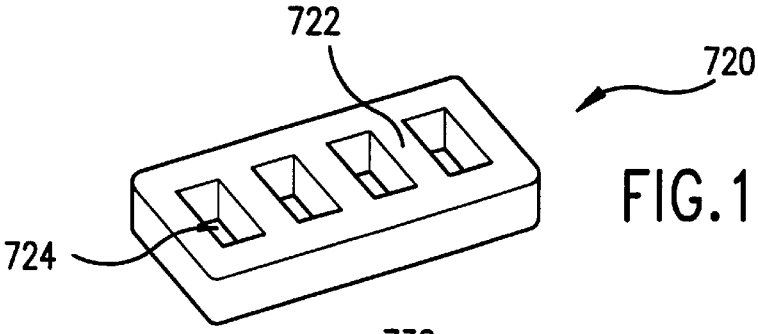
Figure 18C:
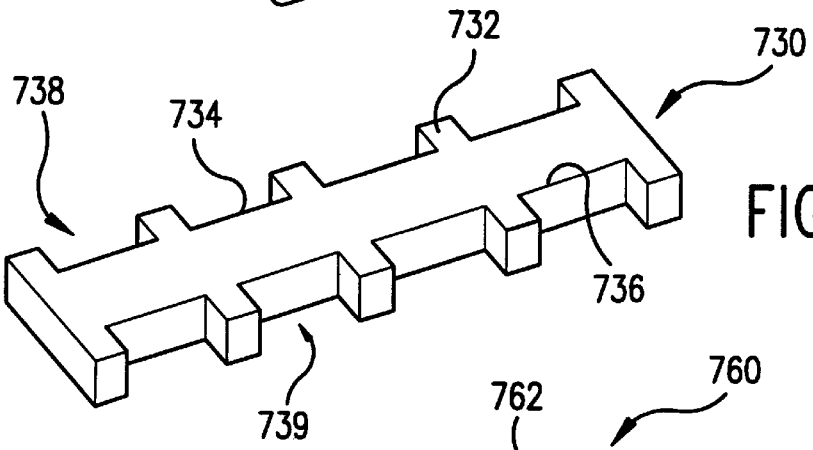
Figure 18E:
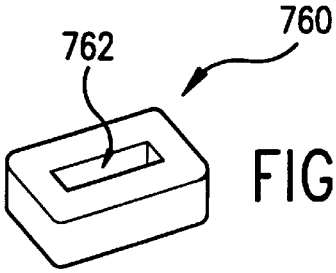
Figure 18D:
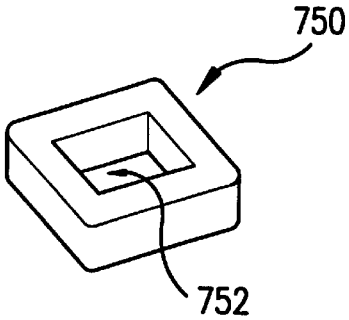
Figure 18F:
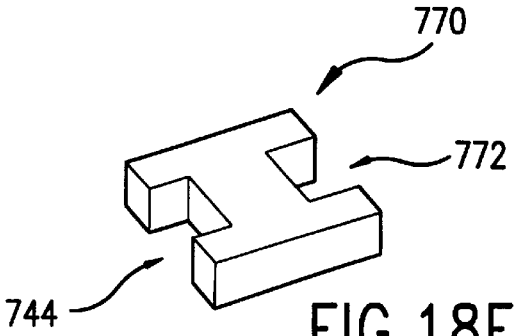

The sixteenth preferred embodiment 290 is illustrated in FIG. 17. The piece 290 is similar to piece 220 of FIG. 13, except that six additional deformable sections 292, 294, 296, 298, 300 and 302 are also provided. A substantially rectangular central aperture 304 is defined by the substantially straight end edges of the sections 300 and 302 and opposing end edges 304 and 306. The relative dimensions of the apertures, the deformable sections and the necks are also substantially the same as those for piece 220.

All apertures and deformable sections according to the present invention are preferably provided in corresponding configurations and sizes so that they can be used universally to interconnect other pieces. However, it is possible to provide apertures and deformable sections in a few different predetermined configurations and sizes so that certain deformable sections will be adapted for use in apertures of the corresponding size and configuration. For example, each piece may be provided with two or more sets of apertures, one set having smaller apertures adapted for connection with smaller deformable sections, a second set having larger apertures adapted for connection with larger deformable sections, and so on.

In addition, any combination of the pieces described in the present invention may be provided in the constructional toy system of the present invention, and any combination of configurations for the apertures and deformable sections can be provided for any piece within the system. For example, although certain embodiments illustrate the provision of apertures having a particular configuration, it is possible to provide different pieces with differently configured apertures, including providing a piece in which each of its apertures has a different configuration, and with each such aperture having a different size for use with deformable sections of different sizes.

Figure 20C:
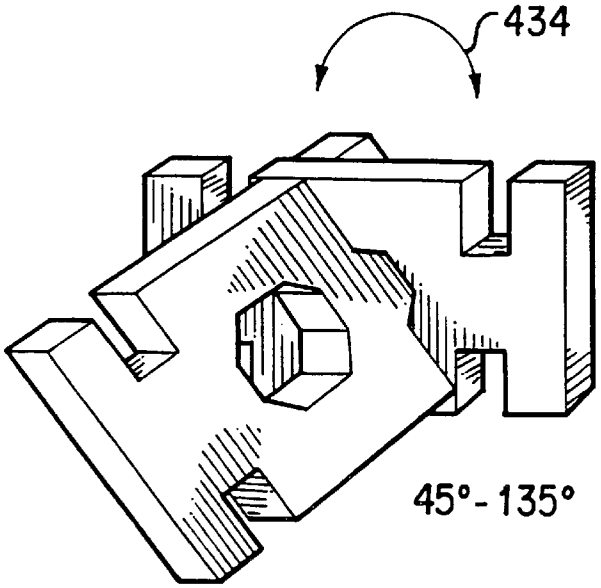
FIGS. 20A–20C illustrate how two pieces according to the present invention are connected.
Figure 20B:
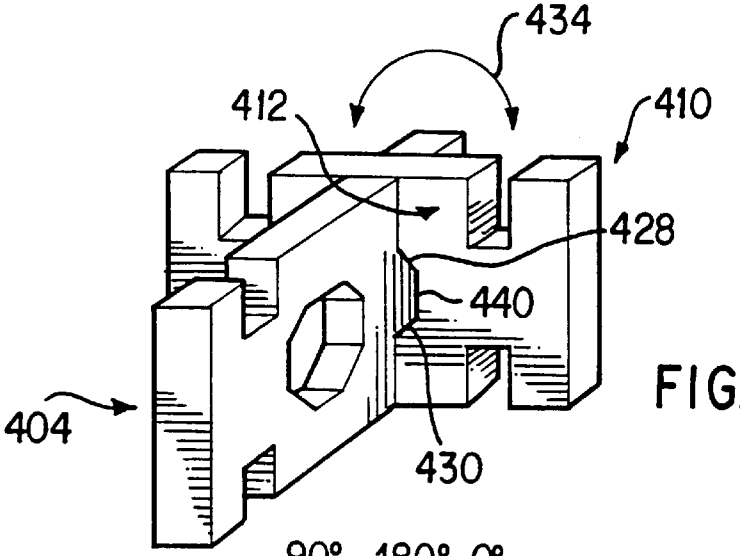
Figure 20A:
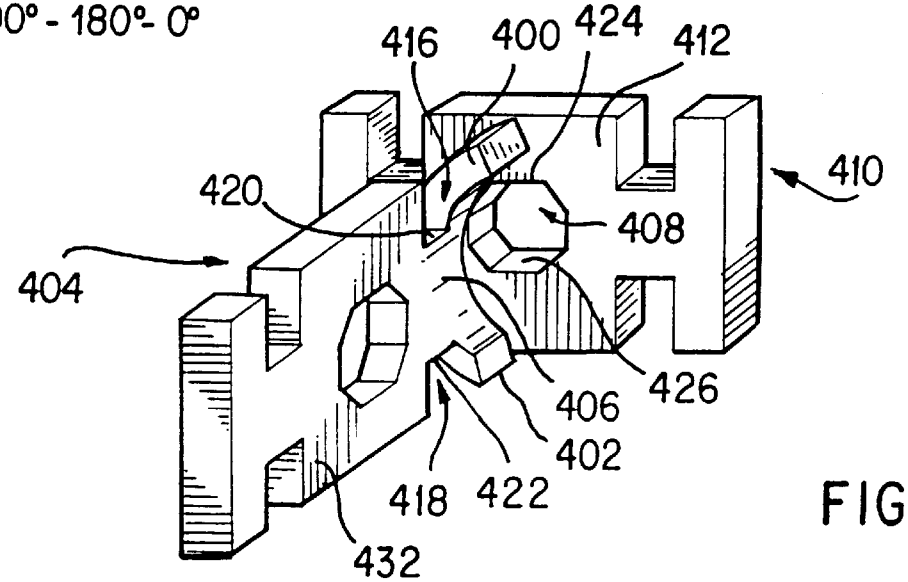

FIGS. 20A–20C illustrate how a deformable section according to the present invention is connected to the aperture of the same piece or another piece. Since the apertures according to the present invention are about half the dimension of the width W of the corresponding tongues, the tongues cannot be inserted through the apertures without deforming the tongues. Therefore, referring to FIG. 20A, the opposing flaps 400 and 402 of the deformable section of a first piece 404 are bent or folded towards each other to reduce the overall profile of the tongue 406 so that the entire tongue 406 can be inserted or passed through the aperture 408 of a second piece 410. The first and second pieces 404 and 410 have a configuration identical to that of piece 96 of FIG. 4A.

After the tongue 406 and its flaps 400, 402 have passed through the aperture 408 (see FIG. 20B), the body 412 of the second piece 410 is received inside the notches 416 and 418 of the first piece, with the neck edges 420, 422 of the notches 416, 418, respectively, positioned adjacent to or in contact with opposing straight edges 424, 426, respectively, of the aperture 408. Opposing straight edges 424, 426 correspond to edges 102*a*, 102*c* of piece 96 in FIGS. 4A and 4B. The curvature of the four convex edges that alternate with the straight edges 424, 426 (for example, two convex edges 428 and 430 shown in FIG. 20B) operate as stop means for the body 432 of the first piece 404 to prevent inadvertent rotation of the first piece 404 relative to the second piece 410.

The relative position of the first piece 404 can be manually adjusted. For example, the first piece 404 may be rotated in either direction of the arrow 434 by forty-five degrees to the position shown in FIG. 20C where the neck edges 420 and 422 are adjacent to or in contact with opposing convex edges 430, and retained in this position. Alternatively, the first piece 404 may be rotated from the position in FIG. 20B in either direction by ninety degrees to a position (not shown) where the neck edges 420 and 422 are adjacent to or in contact with opposing straight edges 440, and retained in this position.

The connection method for the other pieces of the present invention are the same. The opposing flaps of the tongues of a first piece are bent or folded to insert the tongue through the desired aperture, which may be in the first piece or in a second piece. The connected tongue may then be rotated to any desired angle relative to the aperture. Other connections can then be made with other pieces to construct the desired object. It will also be appreciated that one piece can be connected to itself. The simplest example is where one takes an elongated version of piece 110 in FIG. 5, wraps it around one's waist, and connects a deformable section to an aperture to create a belt. Watches, visors and other similar items can be created in a similar manner.

Figure 21:
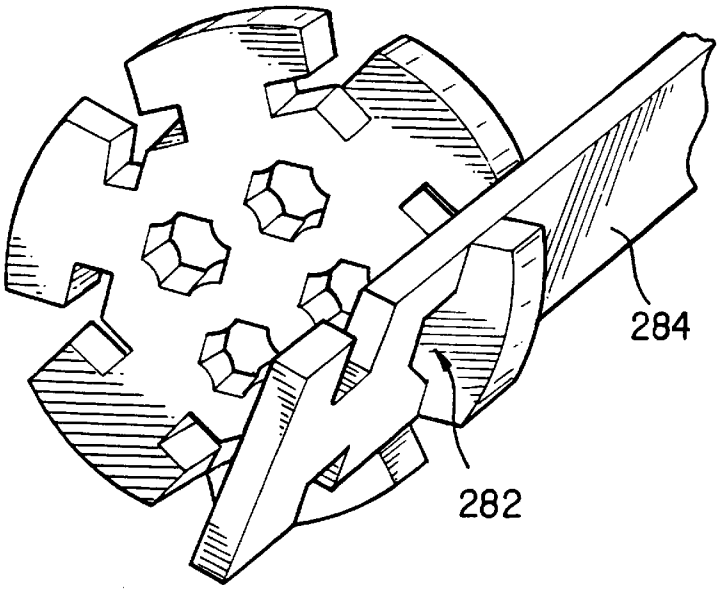
FIG. 21 illustrates the connection of a circular piece with another piece according to the present invention.

FIG. 21. illustrates the connection of the substantially circular piece 280 of FIG. 16, in which one of the deformable sections 282 is connected at an aperture of another piece 284.

To remove the connection, the opposing flaps of the deformed section are folded or bent again, and passed back through the aperture to disengage the two pieces. Although the pieces according to the present invention may be readily disengaged so that the object can be completely disassembled, the structural stability of the resulting object also allows the user to keep the object permanently without any disassembly.

Figure 23:
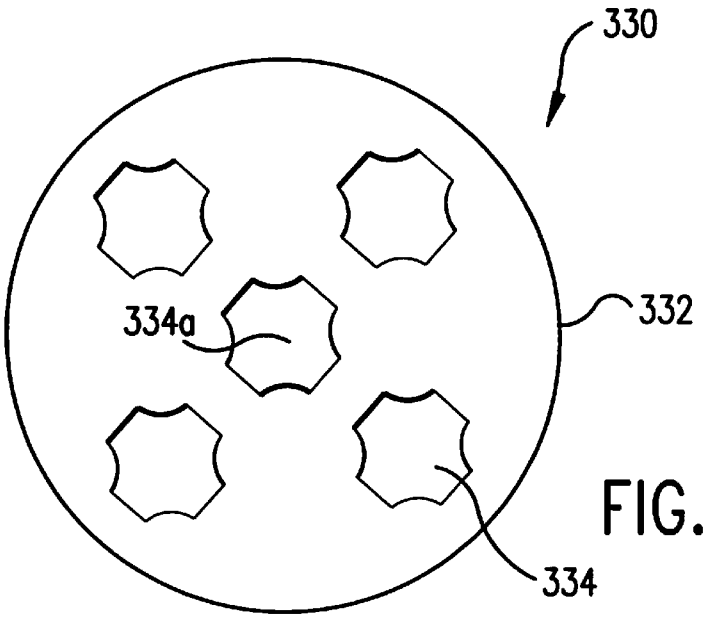
FIG. 23 is a front view of another wheel for use with objects assembled according to the present invention.
Figure 22:
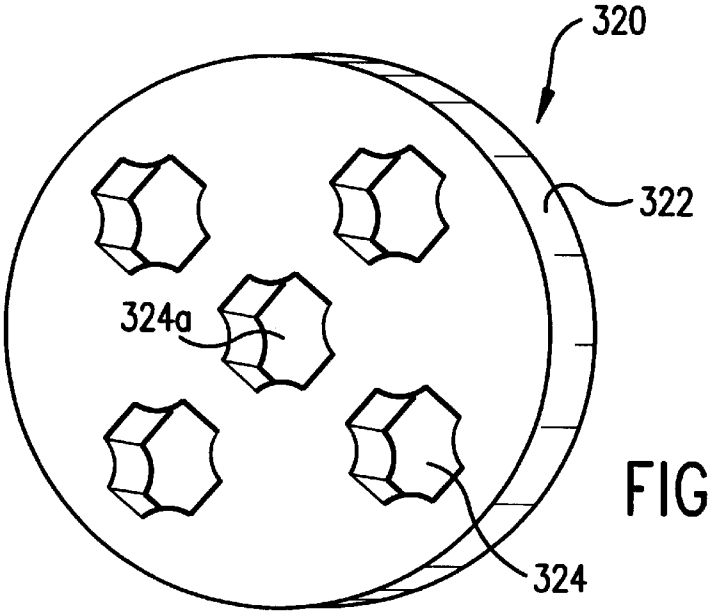
FIG. 22 is a perspective view of a wheel for use with objects assembled according to the present invention.

In addition to the pieces described elsewhere for the present invention, wheels made from the same material as the pieces can also be provided for constructing objects such as automobiles, trains, bicycles or planes. FIGS. 22 and 23 illustrate two wheels 320 and 330, each of which has a cylindrical edge 322, 332, respectively, for rotational contact with a ground or surface. The wheel 320 has five apertures 324, while the wheel 330 has seven apertures 334, each of which is configured as the aperture 98 in FIG. 4A and may be used to connect deformable sections from other pieces. Of course, the apertures 324 and 334 may have a circular or other known configuration, and the wheels 320 and 330 may be provided with a varying number of apertures and in varying sizes.

Figure 25:
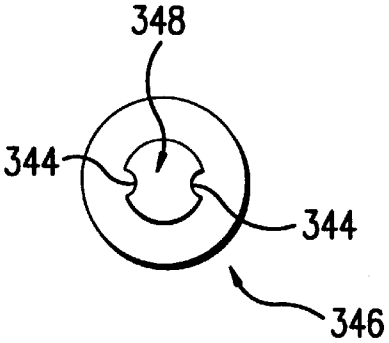
FIG. 25 is a front view of a hub or stop for use with the shaft of FIG. 24 and the wheels of FIGS. 22 and 23.
Figure 24:
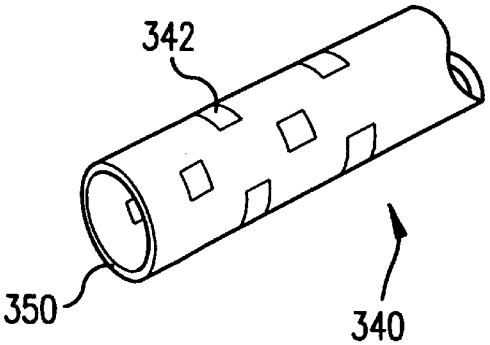
FIG. 24 is a perspective view of a portion of a shaft for use with the wheels of FIGS. 22 and 23.

The central apertures 324*a* and 334*a* of wheels 320, 330, respectively, are adapted to slidably receive a shaft, such as shaft 340 shown in FIG. 24. The shaft 340 is preferably made from a stiffer material, such as but not limited to plastic, high DPE, LDPE or VHMW, although it can also be made from the same material as the pieces. After the shaft 340 has been inserted through the central aperture 324*a* or 326*a*, the wheel 320 or 330 may be rotated about the shaft 340. The shaft 340 is provided with a plurality of openings 342 which are adapted to receive the protrusions 344 of hub or stop member 346 (see FIG. 25). The stop member 346 is also preferably made from the same material as the other pieces, and has a central opening 348 into which the two protrusions extend radially.

In use, after a wheel 320 or 330 has been slid onto the shaft 340, the front end 350 of the shaft 340 is inserted through the central opening 348 of the stop member 346 until the protrusions 344 are received in openings 342 on the shaft 340 to secure the stop member 346 at the desired location along the shaft 340. When used in this manner, the stop member 346 defines the limit of slidable advancement by the wheel 320 or 330.

Referring back to FIG. 1, it can be seen that the pieces according to the present invention can be utilized to construct complex objects having a variety of shapes and sizes. For example, the pieces 450 and 452 can be flexed to simulate curved surfaces, and a wheel is designated at 456. In addition, cut-outs can be provided to fill certain unused apertures, such as at 454, to provide an aesthetically pleasing object. For example, the pieces can be provided in certain pre-determined colors and the cut-outs can be provided in different colors to fill unused apertures in a manner that provides a colorful, playful, creative and eye-pleasing object. The surfaces of the pieces may also be laminated with printed labels or may be directly printed with graphics, decals or other decorative images.

Figure 28:
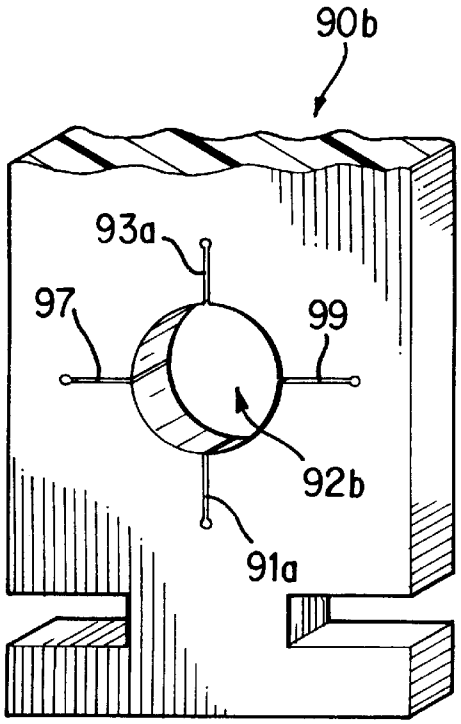
FIGS. 26–28 illustrate a seventeenth embodiment of a piece according to the present invention.
Figure 27:
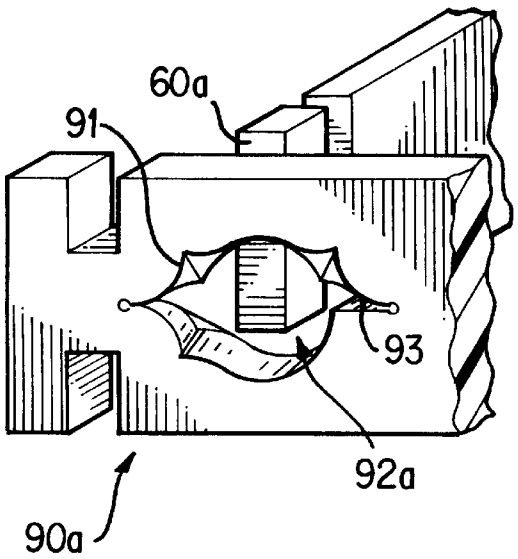
Figure 26:
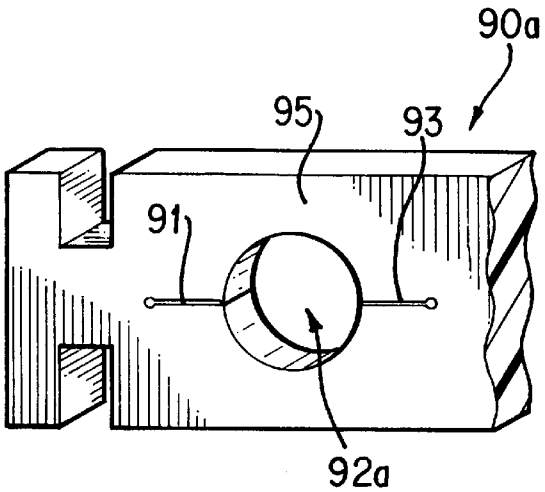

FIGS. 26 and 27 illustrate a seventeenth embodiment 90*a* of the present invention, which includes a modification to the structure of the apertures and to the method of connection. The piece 90*a* of FIG. 26 is essentially the same as piece 90 of FIG. 3A, except that pre-cut slits 91 and 93 are provided on opposing sides of the aperture 92*a*. Referring to FIG. 27, the slits 91 and 93 may be flexed to make it easier for the tongue 60*a* to be bent and passed through the aperture 92*a*. The piece 90*b* in FIG. 28 illustrates that four spaced-apart slits 91*a*, 93*a*, 97 and 99 may also be provided along the outer edge of the aperture 92*b*.

Figure 29:
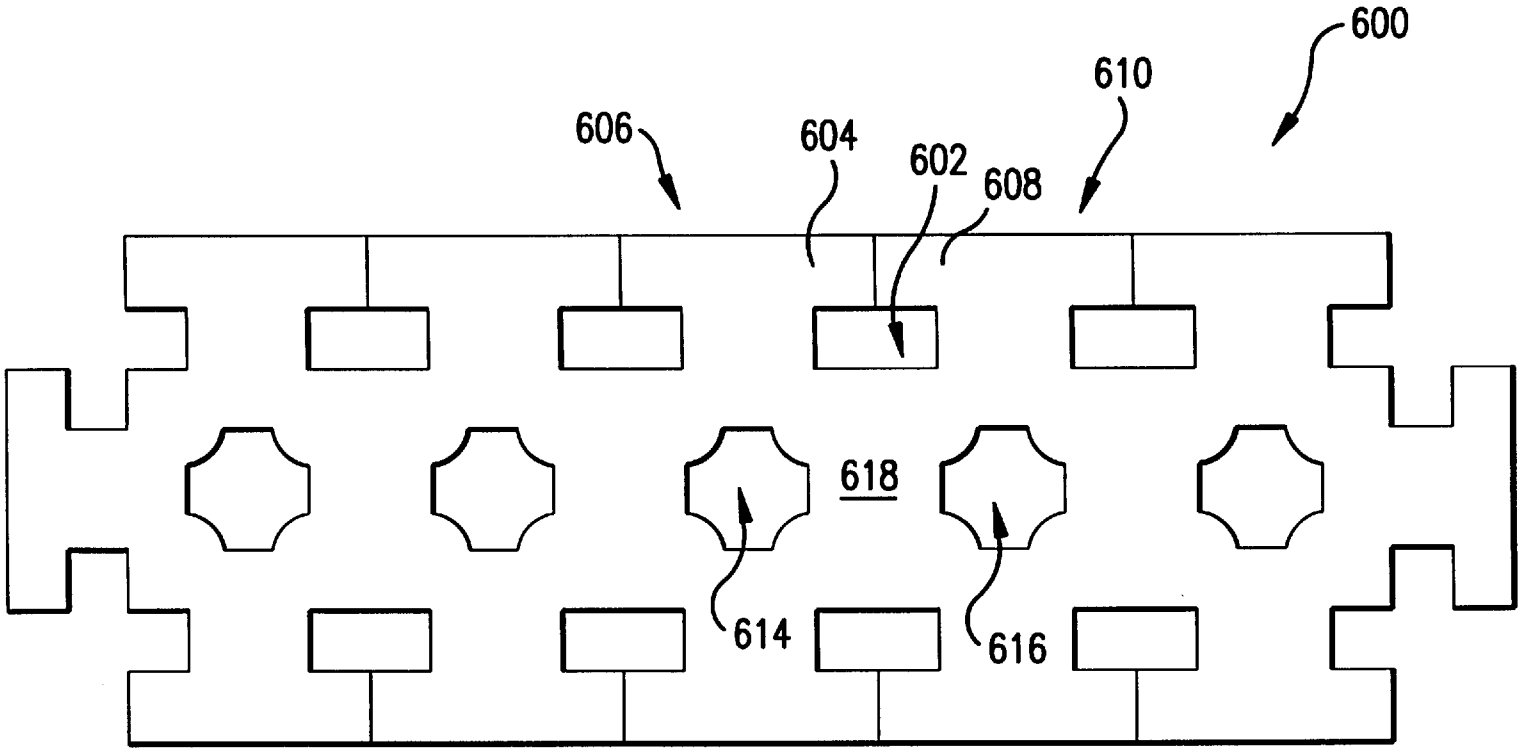
FIG. 29 is a front view of an eighteenth embodiment of a piece according to the present invention.

FIG. 29 illustrates an eighteenth embodiment 600 of the present invention which includes a modification to the piece 210 of FIG. 12. The piece 600 is provided with a plurality of substantially rectangular apertures 602 that are defined in part by the flaps of adjacent deformable sections. For example, flap 604 of deformable section 606 and flap 608 of adjacent deformable section 610 partly define an aperture 602. The piece 600 may be connected to another piece 600*a*, which is identical to piece 600, by inserting the tongues of deformable sections 606 and 610 of piece 600 through central apertures 614 and 616, respectively, of piece 600*a*, so that dividing portion 618 of the piece 600*a* is received in aperture 602 of piece 600.

Figure 30:
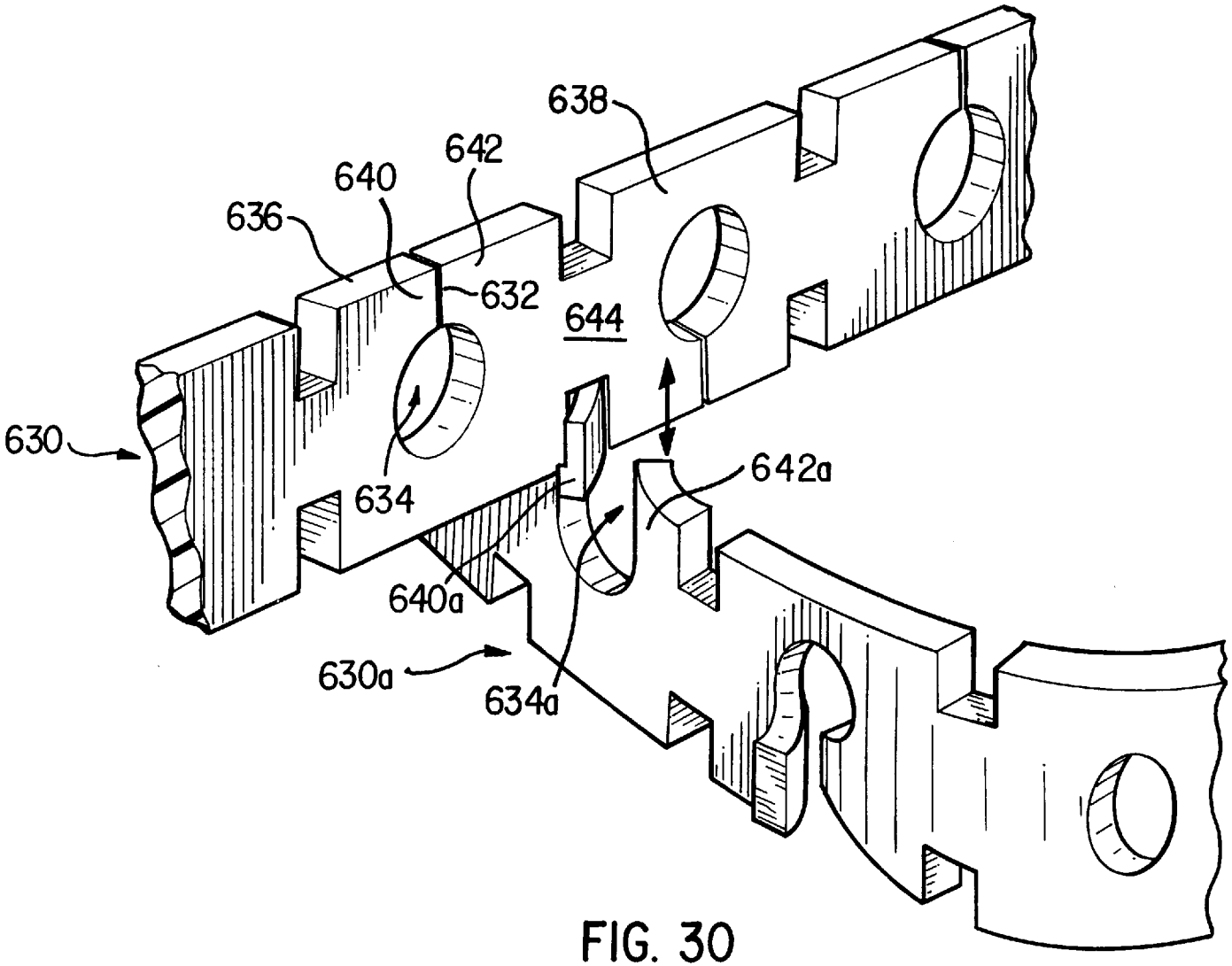
FIGS. 30 and 31 illustrate a nineteenth embodiment of a piece according to the present invention.
Figure 31:
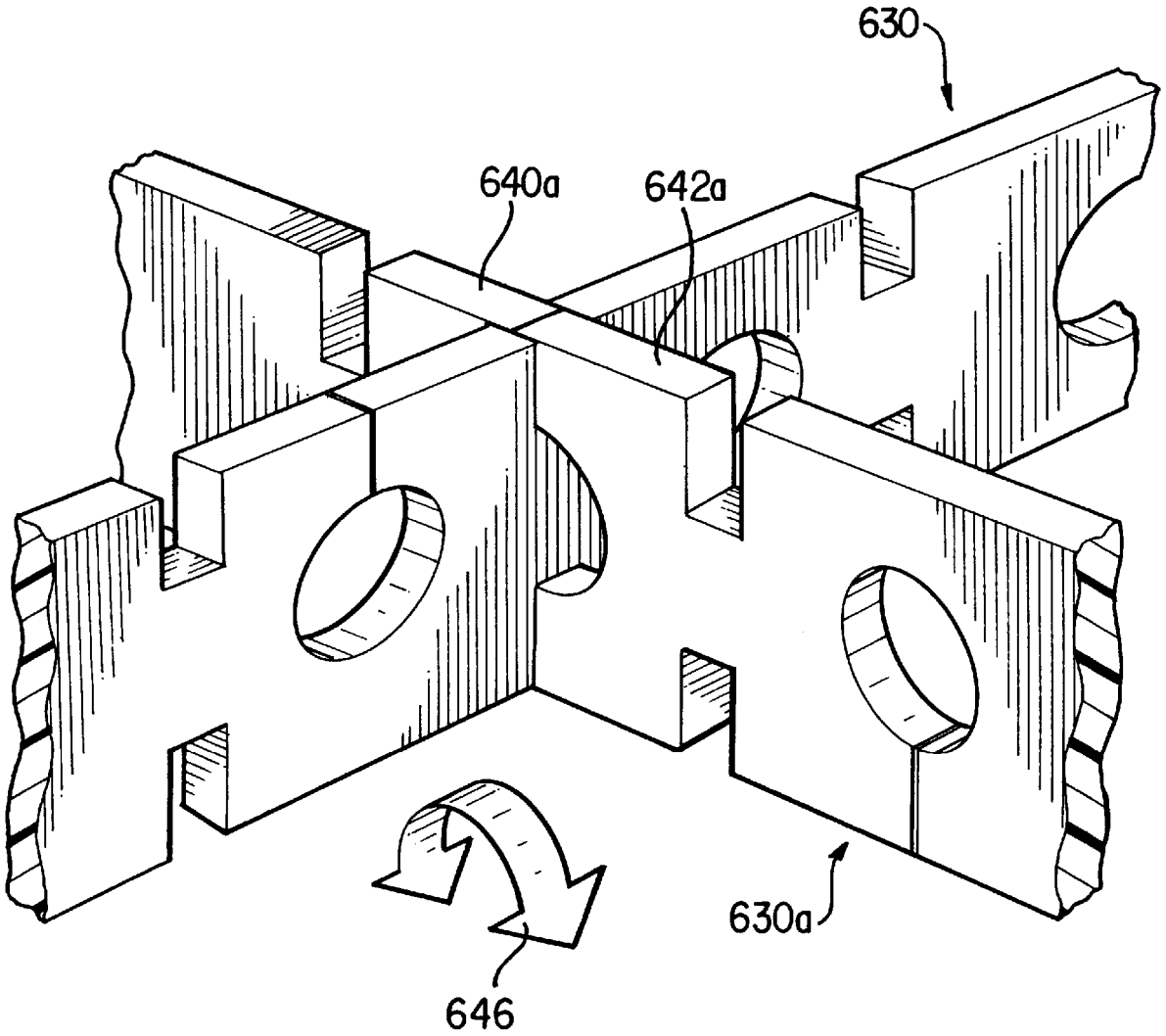

FIGS. 30 and 31 illustrate an nineteenth embodiment 630 of the present invention. The piece 630 of FIG. 30 is essentially the same as piece 90 of FIG. 3A, except that a pre-cut slit 632 has been provided to extend from the aperture 634 to the longitudinal side edge 636 of the body 638 of the piece 630. As shown in the piece 630*a* in FIG. 30, the pre-cut slit allows the body portions 640*a* and 642*a* adjacent the slit to be bent or folded aside to create an opening for inserting the neck portion 644 of the piece 630 therethrough so that the neck portion 644 can be received inside aperture 634*a*. The body portions 640*a* and 642*a* are then allowed to return to their original position, resulting in the connection shown in FIG. 31. As indicated by the arrow 646, the piece 630 may be rotated relative to the piece 630*a* to achieve the desired relative position.

Figure 32:
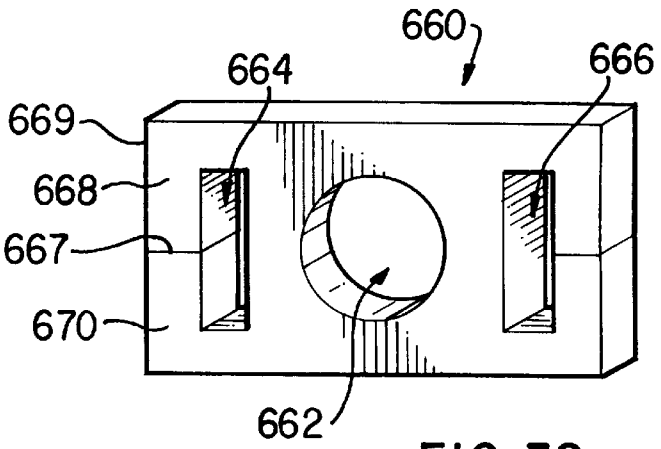
FIGS. 32 and 33 illustrate a twentieth embodiment of a piece according to the present invention.
Figure 33:
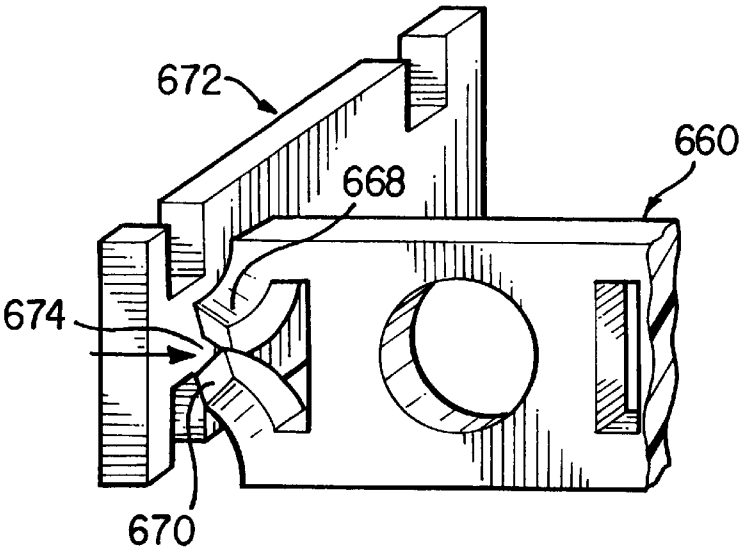

FIG. 32 illustrates a twentieth embodiment 660 of the present invention. The piece 660 has a central aperture 662 and two side apertures 664 and 666. A pre-cut slit 667 extends from about a central portion of the aperture 664 to the side edge 669 of the piece 660 to define deformable flaps or body portions 668 and 670 that may be bent or folded, as shown in FIG. 33, to create an opening at about the slit 667 for inserting the neck portion 674 of another piece 672 therethrough so that the neck portion 674 can be received inside aperture 664. The flaps 668 and 670 are then allowed to return to their original position to complete the connection. The side aperture 666 likewise has a pre-cut slit and deformable flaps and operate in the same manner as side aperture 664.

Figure 34:
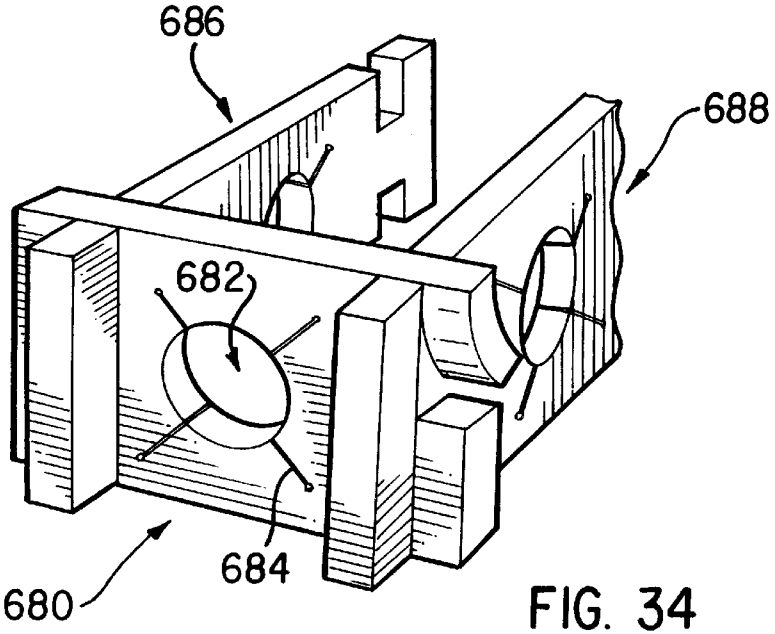
FIG. 34 is a perspective view illustrating a twenty-first embodiment of a piece according to the present invention.

FIG. 34 illustrates a twenty-first embodiment 680 of the present invention. The piece 680 is essentially the same as piece 660 of FIG. 32, except that the central aperture 682 is also provided with a plurality of pre-cut slits 684 that are similar in principle to the slits 91*a*, 93*a*, 97 and 99 described in connection with the piece 90*b* of FIG. 28. The piece 680 is shown in FIG. 34 as being connected at its side apertures to the neck portions of two other pieces 686 and 688.

In addition to the pieces and wheels described hereinabove, the constructional toy system according to the present invention may further include a set of connectors that are used to connect two or more pieces. These connectors are preferably made from the same material as the pieces. Six non-limiting examples of connectors are illustrated in FIGS. 18A–18F, and FIG. 19 illustrates these connectors in use. It will be appreciated that connectors having different configurations and sizes can be provided without departing from the spirit and scope of the present invention.

Figure 19:
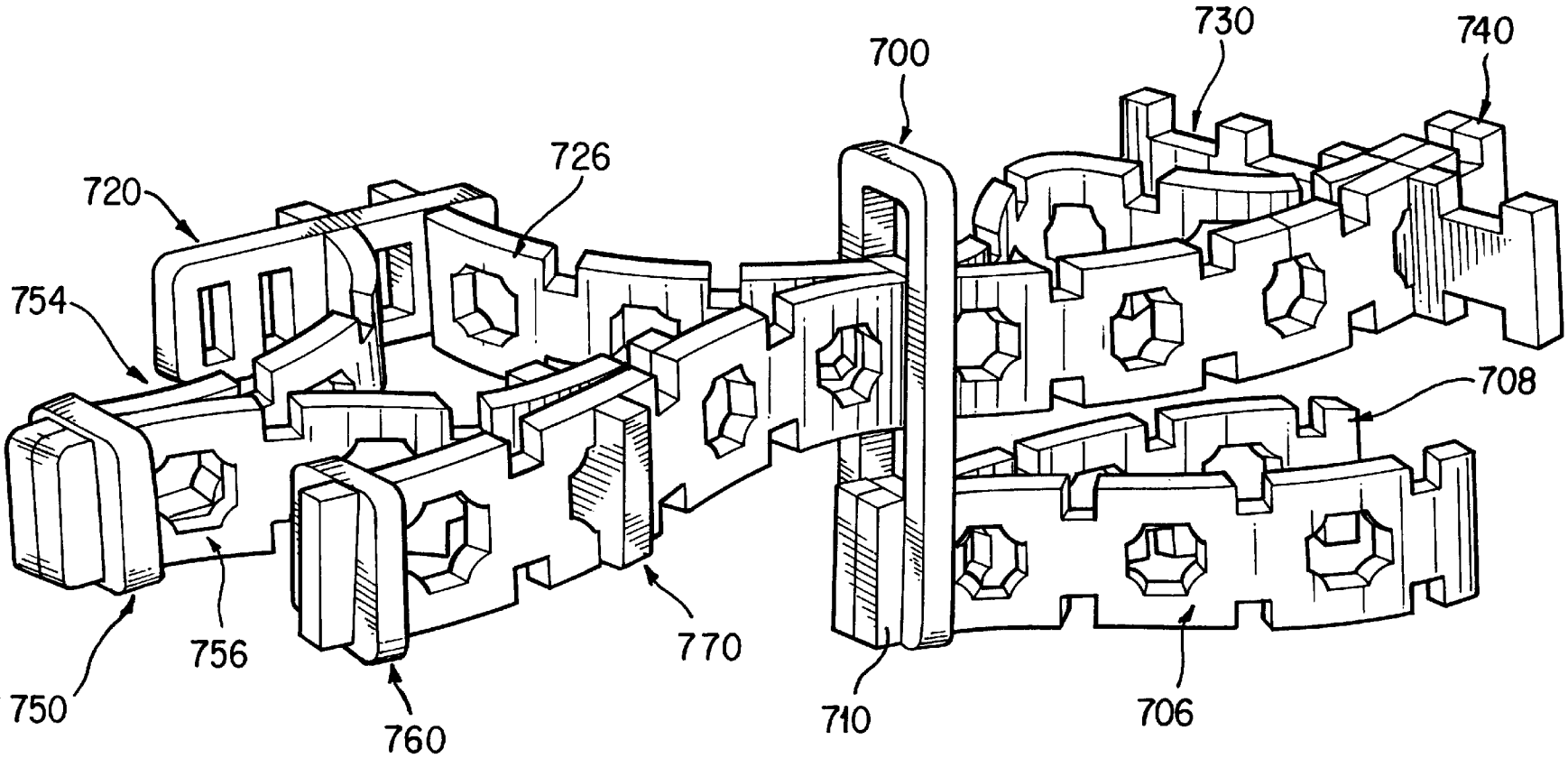
FIG. 19 illustrates the use of some of the connectors of FIGS. 18A–18F in connecting two or more pieces.

Connector 700 has a plurality of bars 702 defining a plurality of apertures 704 which are sized to receive two or more pieces, such as pieces 706 and 708 in FIG. 19. The connection is accomplished by inserting the tongue, for example tongue 710 of piece 706, through an aperture 704 so that the notches adjacent the tongue 710 receive the bars 702 that are adjacent to the connected aperture 704. Alternatively, the piece 706 can be twisted by ninety degrees so that the notches adjacent the tongue 710 receive the longitudinal side walls 712 of the connector 700.

Connector 720 also has a plurality of bars 722 defining a plurality of apertures 724. However, unlike connector 700, the apertures 724 are sized to receive one piece, such as piece 726 in FIG. 19. The connection is accomplished in the same manner described above.

Connector 730 is a longitudinal strip of material having protrusions 732 extending along its longitudinal side edges 734 and 736 that define opposing sets of notches 738, 739. The body or neck of the connector 730 may be inserted through slits formed, for example, in pieces 726 and 740 in FIG. 19 to be received inside appropriate apertures of the pieces 726 and 740. Thus, as shown in FIG. 19, one set of notches 738, 739 of the connector 730 can be used to connect or hold the ends of two pieces 726 and 740 in side-by-side manner. Alternatively, each pair of opposing notches 738, 739 may also be sized to receive the body of only one piece.

Connector 750 is shaped substantially as a ring with a single aperture 752 that is sized to receive two or more pieces, such as pieces 754 and 756 in FIG. 19. The connection is accomplished in the same manner described above for connectors 700 and 720.

Connector 760 is also shaped substantially as a ring with a single aperture 762. However, aperture 762 is sized to receive only one piece, such as piece 740 in FIG. 19, so it is not a true connector but may used as an end member or other building block for the constructional toy system of the present invention. The connection is accomplished in the same manner described above for connectors 700 and 720.

Connector 770 is similar to connector 730 but it only has one set of opposing notches 772, 774 which, as shown in FIG. 19, is used to connect two pieces 756 and 740 side-by-side in the manner described above for connector 730.

The dimensions of the above-described connectors and alternative connectors are preferably sized so that the pieces within the constructional toy system are compatible for use with these connectors. For example, the width of the aperture 724 in connector 720 is preferably about x since aperture 724 is adapted to receive one tongue. Similarly, the width of the aperture 704 in connector 700 is preferably about 2x if it is adapted to receive two tongues.

The pieces, wheels and connectors according to the present invention may be made by first providing sheets of foam, for example, and then having these sheets cut, for example, by machine-cut or another cutting operation, to provide the pieces in the desired shapes and sizes. The cut-outs, such as cut-outs 82, 94 and 100, that are produced from the cutting operation can be retained for use in the manner described above. In addition, the cut out notches may be retained, if desired, and used to patch or fill in the unused notches in the assembled object.

Thus, the pieces, wheel system, and connectors according to the present invention can be packaged in a constructional toy system which allows the user to assemble a large variety of simple and complex two and three-dimensional objects. Adults and children will find the unlimited possibilities offered by the constructional toy system of the present invention to be challenging and exciting, and to be a good educational toy for children. The connections of the various pieces, wheels and connectors are stable, and the material used is light-weight, so that the assembled objects can be kept in a permanent state and moved around easily.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. An object assembled by interconnecting a plurality of pieces, the plurality of pieces including a first piece and a second piece, each of the first and second pieces including:

a section comprising opposing first and second notches and a tongue defining a neck between the first and second notches, the tongue having a width and opposing first and second flaps, and the neck having a width; and an aperture having a dimension which is smaller than the width of the tongue and a widest dimension of about half of the width of the tongue, and a dimension which is the same as or smaller than the width of the neck;

wherein the opposing flaps of the tongue of the sections of the first piece must be bent to insert the tongue of the first piece through the aperture of the second piece to effectuate a connection of the section of the first piece at the location of the aperture of the second piece, with the neck of the section of the first piece held inside the aperture of the second piece.

2. The object of claim 1, wherein each aperture comprises an edge, and wherein the neck of each section has opposing first and second neck edges at the first and second notches, respectively, with the neck of the section of the first piece fitted in the aperture of the second piece with the first and second neck edges of the section of the first piece contacting the edge of the aperture of the second piece to effectuate the connection.

3. The object of claim 1, wherein the aperture of some of the pieces comprises four straight edges and four convex edges, each of the straight edges being alternated by a convex edge so that each straight edge is opposed by another straight edge within the aperture and each convex edge is opposed by another convex edge within the aperture.

4. The object of claim 1, wherein the aperture of the first and second pieces has a circular configuration with a circumferential edge.

5. The object of claim 2, wherein the aperture of the first and second pieces has four straight edges connected to each other to define a diamond-shaped configuration.

6. The object of claim 1, wherein the aperture of the first and second pieces has three straight edges connected to each other to define a triangular configuration.

7. The object of claim 1, wherein the aperture of the first and second pieces has five or more straight edges connected to each other to define a polygonal configuration.

8. The object of claim 1, wherein the first and second pieces each further comprises a longitudinal side edge, and a slit extending from the aperture to the longitudinal side edge defining first and second deformable body portions adjacent the slit.

9. The object of claim 1, wherein one of the apertures of the first and second pieces further comprises at least one slit extending from the aperture for a short distance along the piece, the slit defining first and second deformable body portions adjacent the slit which are deformed to further facilitate insertion of the tongue through the aperture.

10. The object of claim 1, wherein the object further comprises at least one connector for connecting the first and second pieces, the connector comprising at least one aperture for receiving one neck of at least the first piece or the second piece.

11. The object of claim 1, wherein the object further comprises at least one connector for connecting the first and second pieces, the connector comprising at least one pair of opposing notches for retaining the neck of at least the first piece or the second piece.

12. The object of claim 1, wherein the object further comprises:

a third piece having a generally circular configuration, and including at least one aperture; and a shaft extending through one of the apertures of the third piece.

13. The object of claim 1, wherein the object further comprises a plurality of cut-outs that have the same configuration and size as the apertures of the pieces, for insertion into unused apertures of the pieces.

14. The object of claim 1, wherein the first piece includes a second section, the second section having a tongue with opposing first and second flaps, with the opposing flaps of the tongue of the second section of the first piece bent to insert the tongue of the second section of the first piece through an aperture in the first piece to effectuate a connection of the second section of the first piece at the location of the aperture of the first piece.

* * * * *